US005642132A

United States Patent [19]

Buhr

[11] Patent Number: 5,642,132

[45] Date of Patent: Jun. 24, 1997

[54] CIRCUIT ARRANGEMENT FOR CONTROLLING THE DISPLAY OF A CURSOR SYMBOL OF VARIABLE MAGNITUDE AND SHAPE IN A CURSOR FIELD OF VARIABLE MAGNITUDE

[75] Inventor: Wolfgang Buhr, Hamburg, Germany

[73] Assignee: U.S. Philips Corporation, New York, N.Y.

[21] Appl. No.: 362,606

[22] PCT Filed: May 5, 1994

[86] PCT No.: PCT/IB94/00092

§ 371 Date: Jan. 10, 1995

§ 102(e) Date: Jan. 10, 1995

[87] PCT Pub. No.: WO94/27277

PCT Pub. Date: Nov. 24, 1994

[30] Foreign Application Priority Data

May 10, 1993 [DE] Germany ..... 43 15 471.9

[51] Int. Cl.[6] ..... G09G 5/08

[52] U.S. Cl. ..... 345/145; 345/157

[58] Field of Search ..... 345/145, 157, 345/159, 162

[56] References Cited

U.S. PATENT DOCUMENTS

| | | | |
|---|---|---|---|
| 4,228,430 | 10/1980 | Iwamura et al. | 345/162 |
| 4,354,184 | 10/1982 | Woborschil | 345/145 |
| 4,668,947 | 5/1987 | Clarke, Jr. et al. | 345/162 |
| 4,833,462 | 5/1989 | Goven et al. | 345/157 |
| 5,185,597 | 2/1993 | Pappas et al. | 345/145 |
| 5,192,943 | 3/1993 | Matsuo et al. | 345/145 |
| 5,345,252 | 9/1994 | Hannah | 345/162 |

*Primary Examiner*—Richard Hjerpe
*Assistant Examiner*—Paul Bell
*Attorney, Agent, or Firm*—Brian J. Wieghaus

[57] ABSTRACT

A circuit arrangement for the display of a cursor symbol of variable magnitude addresses the cursor memory by means of a separate addressing device which operates only during display of the cursor field. The organization of the memory for the cursor symbol, constructed as a matrix memory, is fully independent of the rows and columns of the cursor field, i.e. to the cursor symbol the memory appears as a pure linear memory. As a result, this memory can be utilized in a substantially improved manner and the display of even large cursor symbols requires only a limited storage capacity.

6 Claims, 3 Drawing Sheets

CIRCUIT ARRANGEMENT FOR CONTROLLING THE DISPLAY OF A CURSOR SYMBOL OF VARIABLE MAGNITUDE AND SHAPE IN A CURSOR FIELD OF VARIABLE MAGNITUDE

BACKGROUND OF THE INVENTION

The invention relates to a circuit arrangement for controlling the display of a cursor in a raster-like image, and more specifically for controlling the display of a cursor field of various size.

A circuit arrangement of this kind is known from U.S. Pat. No. 4,354,184 and allows for display of a cursor field of selectable magnitude. This cursor field serves to accentuate an image area in a displayed image, consisting notably of a text to be processed, accentuation being realised, for example by brighter display. No cursor symbol is then displayed in the cursor field.

Also known are circuit arrangements whereby a cursor symbol, for example, an arrow, can be displayed in the cursor field, the parts of the cursor field outside the cursor symbol generally not being visible. The shape of the cursor symbol is determined by the contents of a storage field whose magnitude is defined by the circuitry. In many case the image presents not only the cursor but also characters, i.e. letters and digits whose shape is also determined in storage sections of a memory which may be the same as that for the cursor and which are displayed in character fields of uniform magnitude. The magnitude of a character field then corresponds to the magnitude of the cursor field. In the position in which the cursor is displayed, the pans of the characters displayed in this position in the absence of the cursor are covered, but the cursor may in principle also be at least partly transparent, so that the covered parts of the characters can still be displayed, be it, for example in different colours for background and foreground. When the position data of the cursor indicate arbitrary raster pixels and raster lines of the raster-like image, the cursor field can be adjusted independently of the normally flexed position of the character fields, so that the cursor covers parts of several characters. When the cursor is determined by the display of a fixed symbol, the shape of this cursor symbol can also be changed by erasure or modification of the contents of the storage field determining the cursor shape. The magnitude of the cursor field, however, is always the same.

However, it may be useful to display not only different shapes of the cursor symbol, but also different magnitudes of this symbol. This is not allowed for by the known circuit arrangements for the display of a cursor symbol. In the cited circuit arrangement for displaying a cursor field of variable magnitude, a storage field of variable magnitude with more complex addressing circuitry would have to be used for the display of a cursor symbol of variable magnitude.

SUMMARY OF THE INVENTION

Therefore, it is an object of the invention to provide a circuit arrangement of the kind set forth which also enables display of a cursor symbol of variable magnitude and shape in a cursor field of variable magnitude while utilizing only limited storage and addressing means.

This object is achieved in accordance with the invention in that there are provided a cursor memory for storing the data concerning the shape of a cursor symbol to be displayed as well as addressing means for addressing Successive locations of the cursor memory, thereby advancing to the next location after a number of pixel clock signals related to the number of bits in the data word in each location and to the number of bits used for the display of a cursor pixel. Further is provided a serial-parallel-converter for adapting the number of bits in the data word to the number of bits for the cursor pixel.

In known circuit arrangements, the organization of the memory for the cursor symbol shape corresponds to the cursor field, i.e. for a line of the cursor field there is also provided a matrix row of the matrix memory. The addressing means in accordance with the invention cancels this relationship between organization of the character memory for the cursor symbol and the display of this symbol, i.e. a matrix row of the cursor memory can contain several lines of the cursor symbol but also only a fraction of one line of the cursor symbol. When the contents of the cursor memory are exchanged, which operation can be very quickly performed, or when several memory sections are provided for the storage of different cursor symbols, wherebetween switching over takes place as desired, for example a cursor symbol of flashing shape can be displayed. The possibilities for display are numerous when the shape and the magnitude of the cursor field can be adjusted as desired by way of the means in accordance with the invention.

Generally speaking, a cursor symbol is determined by a binary data whose values determine the foreground and background of the cursor field, whereas an individually addressable memory location of a matrix memory generally contains several bits. Such a memory location then contains the information for several successive pixels of the cursor symbol. When the magnitude of the cursor field is chosen so that the width is not an integer multiple of the number of bits of a memory location, some bits will remain at the end of the display of a raster line of the cursor field, the information of said remaining bits having to be displayed at the beginning of the next raster line of the cursor field. However, this requires comparatively complex control circuitry. In an embodiment of the invention, therefore, the addressing unit is advanced to the next address in response to each new raster line. Even though the capacity of the cursor memory is not optimally used, the control of the display is thus substantially simplified.

A specific embodiment of the circuit arrangement in accordance with the invention includes first registers for storing position data determining the position of the cursor in the image, a second register for the number of lines of the cursor, and a third register for the number of pixels per line of the cursor. This embodiment further includes a first counter for counting a number of lines which corresponds to the contents of the second register, and a second counter for repeated counting of a number of pixels corresponding to the contents of the third register for each new line. The first registers comprise a first sub-register for storing the position of the cursor in the horizontal direction in the image and a second sub-register for storing the position of the cursol in the vertical direction in the image A. A comparator which generates a first start signal when the horizontal control signals equal the contents of the first sub-register in order to set the first counter to a position corresponding to the contents of the second register and, subsequently, to make the first counter count at a pixel frequency until it reaches an initial position and to make it output a horizontal window signal for the duration of the comparator also generates a second start signal when the vertical control signals equal the contents of the second sub-register in order to set the second counter to a position corresponding to the contents of the third register and, subsequently, to make the second counter count at a line frequency until it reaches an initial position and to make it output a vertical window signal for the duration of counting, the combination of the two window signals determining the display of the cursor. Such an implementation requires only a limited amount of circuitry. The combination of the two window signals can be realised in various ways.

In a further embodiment of the invention a first possibility consists in that there is provided a logic element for generating a cursor window signal from the two window signals, which cursor window signal serves to control a switch which applies the data output by the cursor memory to a display device. The two window signals are then directly combined by way of an AND-function and control a switch which switches over from the display of the actual image to that of the cursor field so that the cursor symbol is superposed on the other image information in the image. Moreover, the cursor window signal generated by the logic element controls the addressing of the cursor memory as will be described in detail hereinafter.

In a further embodiment of the invention, another possibility of combining the two window signals consists in that the second counter serves to count the pixels only during the counting by the first counter and generates a cursor window signal during counting, which cursor window signal serves to control a switch which applies the data output by the cursor memory to a display device. The second counter then operates only during the display of the cursor field in the image, so that the cursor window signal can be derived directly from this counter.

BRIEF DESCRIPTION OF THE DRAWINGS

Embodiments of the invention will be described in detail hereinafter with reference to the drawing. Therein.

DESCRIPTION OF THE PREFERRED EMBODIMENT

Figure 1:
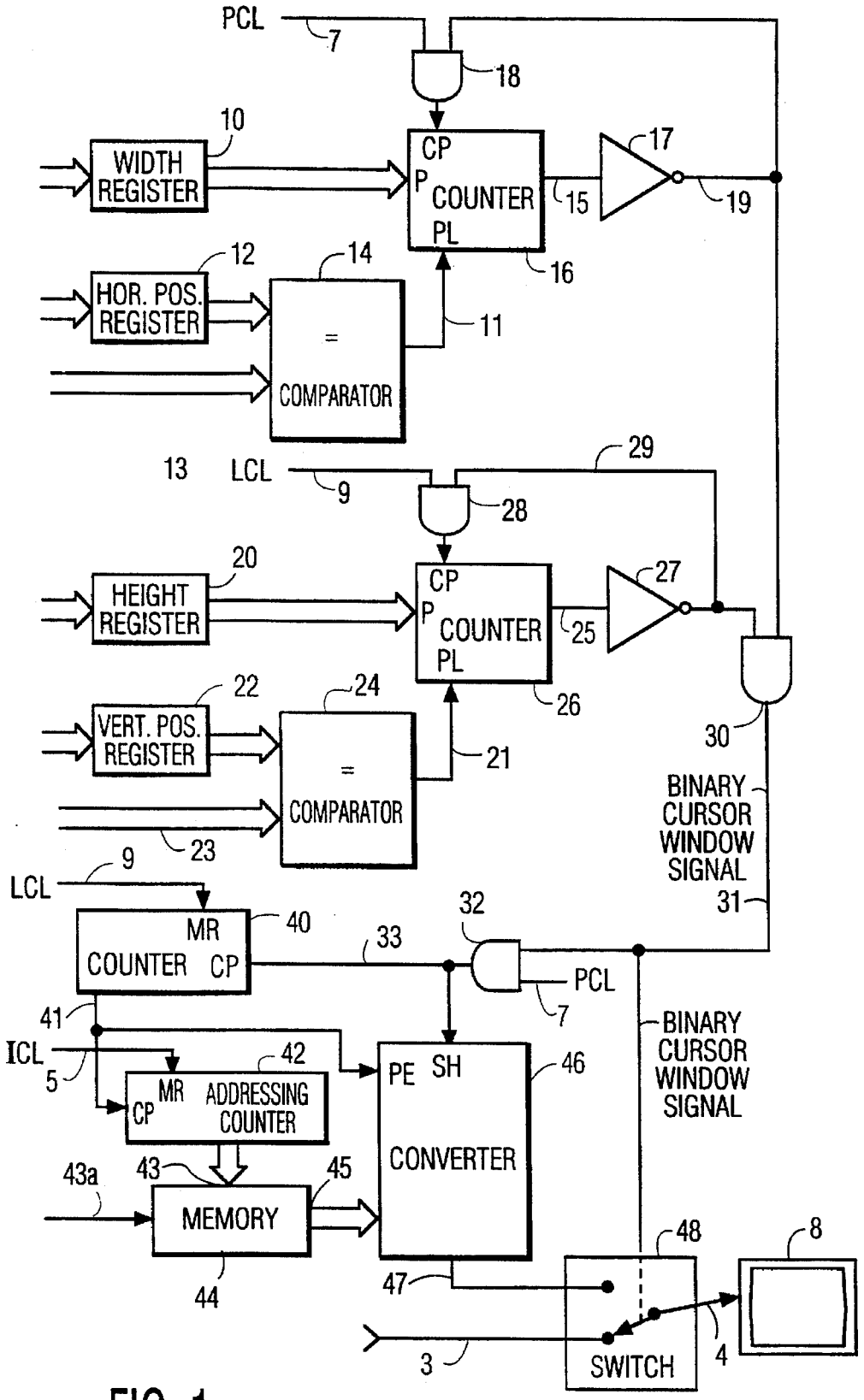
FIG. 1 shows a block diagram for controlling the display of a cursor in accordance with the invention.

The blocks 10, 12, 20 and 22 in FIG. 1 represent registers which receive information, for example via a data bus (not shown), and which can optionally store this information. The value in the register 10 represents the width of the cursor field, whereas the register 20 determines the height of the cursor field. The contents of the register 12 indicate the horizontal position of the left-hand edge of the cursor field, whereas the contents of the register 22 indicate the position of the upper edge of the cursor field. Via the leads 13 and 23 control signals are received from an image control circuit (not shown), which control signals indicate the instantaneous position of the display point in the image, notably the position of the electron beam on the display screen of a picture tube.

The contents of the register 12 are applied to an input of a comparator 14, a further input of which is connected to the lead 13 for the horizontal control signals. When the data on the two inputs corresponds, the comparator 14 outputs a signal via the output lead 11, which signal is applied to the set input or programming input PL of a counter 16. This signal sets the counter 16 to a position which corresponds to the contents of the register 10 connected to the data inputs P of the counter 16.

In an initial position, for example, its zero position, the counter 16 outputs, via an output 15, a logic signal "1" which generates a logic signal "0" on the lead 19 via an inverter 17. This blocks an AND-gate 18 whose other input receives a pixel clock signal PCL via the lead 7. When the counter 16 is set to a position other than its initial position by a signal on the lead 11, a logic signal "0" appears on the output 15 and hence a logic signal "1" appears on the lead 19, so that the pixel clock signal on the lead 7 is applied to a count input CP of the counter 16 via the AND-gate 18. The counter 16 then counts back to its initial position at the pixel clock frequency, the number of pixel clock pulses required being determined by the contents of the register 10. When the initial position is reached, a logic signal "1" is again formed on the output 15, so that a logic signal "0" again appears on the lead 19, via the inverter 17, which signal "0" blocks the AND-gate 18 and prevents further counting by the counter 16. Thus, a logic signal "1" appears on the line 19 for the horizontal position, i.e. the width of the cursor field in the image, regardless of its vertical position, and represents a horizontal window signal.

Similarly, a comparator 24 compares the vertical position data of the register 22 with the vertical control signals on the lead 23 and in the case of correspondence it generates a signal on the output lead 21 which sets a counter 26 to a position determined by the contents of the register 20. The counter 26 also produces a logic "1" on its output 25 in its initial position, which logic "1" produces a logic signal "0" on the lead 29 via an inverter 27. When the counter 26 is set to a position other than its initial position by a signal on the lead 21, a logic "1" signal appears on the lead 29 in the same way as described above, which logic "1" signal enables an AND-gate 28 so that a raster clock signal LCL on the lead 9, comprising a pulse for each new raster line in the image, is applied to a counting input CP of the counter 26. Thus, in response to each new raster line displayed in the image, the counter 26 counts down one position until ultimately it reaches its initial position and again generates a logic signal "1" on the output 25, resulting in a logic signal "0" on the lead 29, via the inverter 27, which logic signal "0" blocks the AND-gate 28 and prevents further counting by the counter 26. Thus, a logic signal "1" is present on the lead 29 for the entire height of the cursor field, regardless of the horizontal position of the cursor field, and represents a vertical window signal.

The two leads 19 and 29 are also connected to two inputs of a clip means in the form AND-gate 30, the output 31 of which thus generates a logic signal "1" when the cursor field of the specified height and specified width is generated in the image, hence representing a binary cursor window signal.

The lead 31 is connected to an input of an AND-gate 32, another input of which receives the pixel clock signal PCL on the lead 7. Consequently, whenever the instantaneously displayed pixel is situated within the desired cursor field, the pixel clock signals PCL supplied via the lead 7 appear on an output lead 33 of the AND-gate 32. These clock signals are applied on the one hand to a count clock input CD of a counter 40 which operates as a frequency scaler as will be described hereinafter. This means that after a predetermined number of signals, when the counter 40 passes through a respective predetermined initial position a pulse is supplied on the lead 41. These pulses on the lead 41 are applied to a count input CD of an addressing counter 42 whose counts are applied in parallel to an address input 43 of a memory 44 which contains the information for the cursor symbol. At each addressed memory location the memory 44 contains a data word which consists of a number of bits and which is output in parallel via a data output 45.

This data word is applied to a parallel input of a parallel-serial converter 46. A load input PE of this converter receives the pulses on the lead 41, that is to say the pulses delayed by the response times of the address counter 42 and the memory 44 (the delay not shown for the sake of simplicity), so that the data word read from the memory 44 is taken over in parallel. Furthermore, on a shift input SH the parallel-serial converter 46 receives the pixel clock signals PCL which occur on the lead 33 during the display of the cursor field and with which the data word taken over in parallel from the memory 44 is serially output via an output 47.

The data output 47 is connected to an input of a mixing means in the form of switch 48, another input of which receives, via the lead 3, the information for a complete image from a source (not shown). The switch 48 switches an output 4, applying the image information to a display device 8 such as, for example a picture tube, during the display of the cursor field, from the lead 3 to the lead 47 under the control of the cursor window signal on the lead 31, so that the display device for the display of the cursor field receives the corresponding cursor information. The switch is shown as a mechanical switch but it is evidently of an electronic type. It can also be constructed in a different manner than a simple switch, for example in order to superpose the cursor field on the image in a transparent or semi-transparent fashion.

When it is assumed for the foregoing description that the memory 44 contains only 1 bit for each pixel of the cursor field and that each address stores a data word comprising, for example 16 bits, a counter having 16 positions is used for the counter 40 and the parallel-serial converter 46 has a capacity of at least 16 bits. As can be readily understood, after the display of 16 pixels in the cursor field, the address counter 42 is then advanced to the next position and the data word read is transferred to the parallel-serial converter 46. The capacity of the counter 40 and of the parallel-serial converter 46 is thus dependent on the data word width of the memory 44.

When it is also assumed that a cursor field having a width of 30 pixels is to be displayed, two data words are required for this purpose. The last two bits of the second data word can then be displayed in the next raster line of the cursor field. This requires a slightly complex organization, however, notably also for generating the data words of the memory 44 which contain the information for the cursor symbol. In the block diagram shown in FIG. 1, therefore, the counter 40 receives the line clock signal LCL on the lead 9 on a reset input MR, which line clock signal comprises a pulse for each new raster line during display of the image. Thus, in response to each new raster line on the output 41 there is also generated a pulse which switches the addressing counter 42 to the next address of the memory 44, the data word stored at that address being read and transferred to the parallel-serial converter 46. Consequently, each time the last two bits of every other data word are not used. This also holds in a similar manner for other magnitudes of the cursor field.

Because most display devices such as, for example picture tubes, operate periodically, i.e. the image is repeatedly displayed completely, the addressing counter 42 receives a clock signal ICL on a reset input MR, via a lead 5, which clock signal carries a pulse for each new image. Consequently, for each new image the addressing counter 42 starts counting again in the same position. When only a single bit is used for each pixel of the cursor field, only two colours can be reproduced therein, i.e. a foreground colour and a background colour determined by the contents of a register (not shown) which is customarily connected Between the output of the switch 48 and the information lead 4 to the display device 8 and which can be loaded as desired. This register generates multi-bit colour information from the binary pixel information. However, it is alternatively possible to use several bits of a data word of the memory 44 for each pixel of the cursor field, which bits can thus directly indicate the colour of the individual pixels. To this end, the parallel-serial converter 46 is constructed in a way to output several successive bits of the data word in parallel on the output 47, and the counter 40 is given a capacity equal to the data word width of the memory 44 divided by the number of bits for each pixel of the cursor field. For example, in the case of a data word width of 16 bits and the use of 4 bits for each pixel, the counter 40 should then divide by 4.

The capacity and the organization of the memory 44, notably when constructed as a matrix memory, is independent of the shape and the magnitude of the displayed cursor field, provided that the memory 44 has at least a capacity which suffices for the largest cursor field to be displayed. However, the memory 44 may also have a substantially higher capacity so that the information for several cursors with different shapes, magnitudes and/or colours can be stored. To this end, the memory 44 is preferably subdivided into several sections which can be selected via more significant address bits applied via the lead 43*a*.

The memory 44 may be a read-only memory or ROM, but it is preferably constructed as a RAM whose contents can thus be readily ovenvritten. The modification of the memory contents, i.e. the cursor, can take place within a fraction of the time required for displaying an image, so that a cursor can be displayed which moves not only in respect of position but also in respect of shape.

Figure 2:
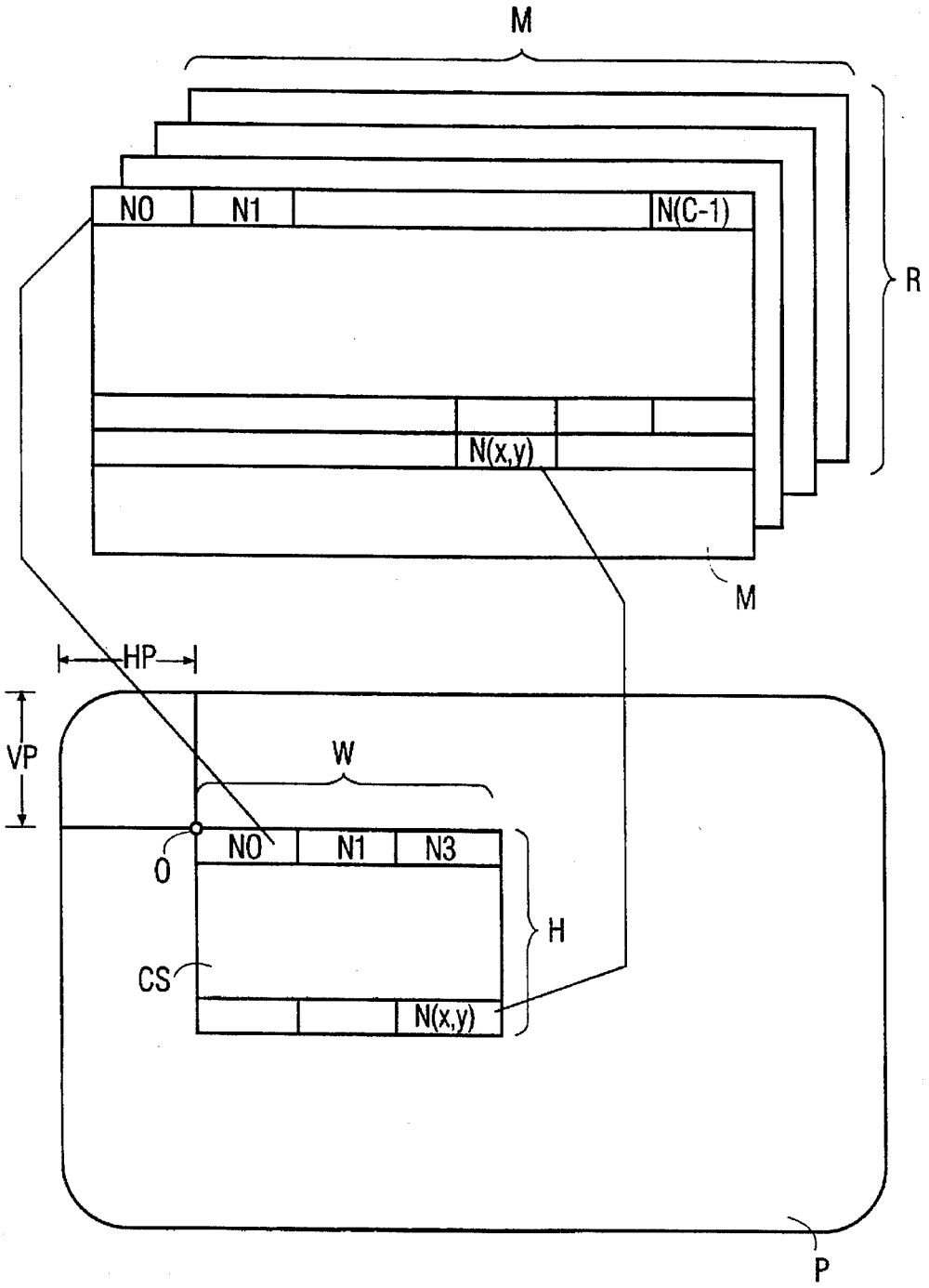
FIG. 2 shows a diagram illustrating the relationship between the displayed cursor and the addressing of the memory for the cursor symbol.

FIG. 2 symbolically illustrates the relationship between the memory organization and the cursor display. Therein, for the sake of clarity the memory M is shown as a three-dimensional memory consisting of four layers, each with a matrix of data words. The four layers contain respective, different information for a cursor and are selected by more-significant address bits; for the sake of simplicity, only a single layer for one cursor shape will be described. This layer contains a number of data words which are arranged in a matrix in C columns and R rows. The data words of the first row are denoted by the references N0, N1 etc. to N(C−1), each data word presumably comprising D bits. The overall capacity of a layer then amounts to R x C x D bits.

A cursor of a magnitude of W pixels and H raster lines is displayed on the display surface P. When the cursor shape is stored only in the form of 1 bit for each pixel, the first D pixels of the first raster line are determined by the data word N0, the next D pixels being determined by the second data word N1, etc. The last pixels of the first raster line are determined by the data word N3 which, however, is not the last data word of the first matrix row in the matrix M of the memory. This also holds for the further pixels of the cursor field, and the last pixels in the last raster line of the cursor field CS are determined by the data word N(x,y) which may thus be situated, in dependence on the magnitude of the cursor field CS, in an arbitrary position within the matrix of the memory M. The organization of the memory M can thus be fully independent of the composition of the cursor field CS, because in respect of the addressing for the display of the cursor field CS the memory M appears as a pure linear memory. This enables very flexible display of cursors of different magnitude and different shape, the cursor field CS evidently always being rectangular.

As has already been stated, the magnitude of the cursor field CS is determined by the contents of the registers 10 and 20 in FIG. 1, the contents of the register 10 determining the width W whereas the contents of the register 20 determine the height H. The position of the cursor field CS on the display surface P is defined by the left-hand upper point 0, i.e. by the number HP of pixels separating the point 0 from the left-hand edge, and by the number VP of raster lines separating the point 0 from the upper edge. As has already been stated, this position is determined by the contents of the registers 12 and 22, the register 12 determining the horizontal position, i.e. the number HP of pixels, whereas the register 22 determines the vertical position, i.e. the number VP of raster lines.

Figure 3:
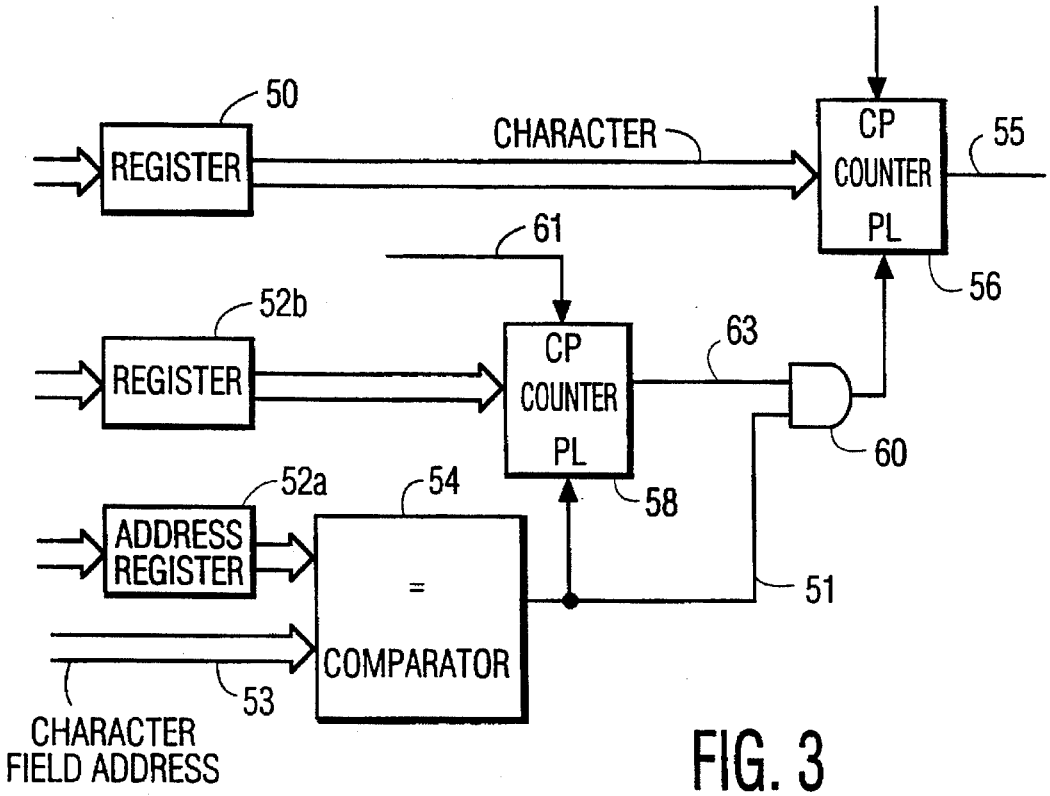
FIG. 3 shows a block diagram of a detail for determining the position of the cursor in the image.

The position of a cursor in an image is often not indicated directly by these numbers of pixels and raster lines; instead for display of characters on the display surface P the latter is subdivided into a matrix of character fields, each character field covering the same number of pixels and raster lines and each character field being addressable. The position of a cursor field is then determined by the address of a character field and by the indication of the number of pixels and raster lines whereby the left-hand upper corner of the cursor has been displaced relative to the left-hand upper corner of the addressed character field. Such an indication of the cursor position necessitates a slight modification of the block diagram of FIG. 1, as indicated in the block diagram of FIG. 3. The block 50 denotes a register which corresponds to the register 10 or 20 in FIG. 1. Similarly, a counter 56 corresponds to the counter 16 or 26 in FIG. 1, and a comparator 54 corresponds to the comparator 14 or 24 in FIG. 1, be it that it no longer compares the control data with the cursor position; instead, the comparator 54 receives, via the lead 53, the address of a character field and compares it with the address stored in a register 52*a* and indicating the character field in which the cursor is to be positioned. When the two addresses correspond, i.e. the display point reaches the desired character field position, the comparator 54 outputs, via the lead 51, a signal which is applied to a set input PL of a counter 58. The counter 58 thus takes over the value supplied by a register 52*b* and indicating the shift of the cursor position relative to the character field position. Via a lead 61, a count input CP of the counter 58 continuously receives clock signals, that is to say pixel clock signals, when the arrangement shown in FIG. 3 replaces the elements 10, 12, 14 and 16 of FIG. 1, whereas the lead 61 receives a raster line clock signal when this arrangement replaces the elements 20, 22, 24 and 26 of FIG. 1. In response to these clock signals, the counter 58 counts down to its initial position; upon reaching of this position a logic signal "1" appears on the output 63. Because a logic signal "1" is also present on the lead 51, since the display point is still within the addressed character field, the inputs of an AND-gate 60 connected to the leads 51 and 63 both receive a logic signal "1", so that a programming input PL of the counter 56 is driven so as to accept the value present in the register 50 in the counter 56. The further operation is as described for the counters 16 or 26 in FIG. 1.

Figure 4:
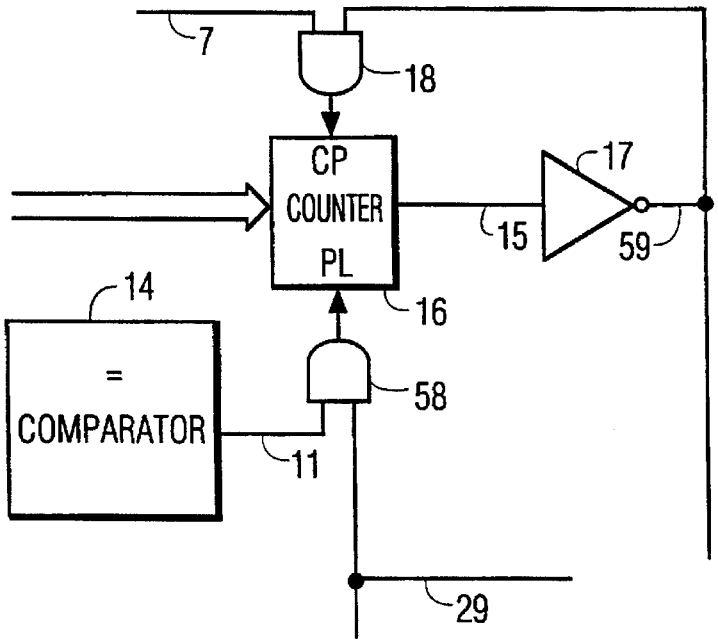
FIG. 4 shows a different implementation for generating the cursor window signal.

In the circuit shown in FIG. 1, the horizontal window signal over the entire height of the display surface is generated on the lead 19, and on the lead 29 the vertical window signal over the entire width of the display surface is generated, the actual cursor window signal being formed only by the combination of these two signals in the AND-gate 30 during the cursor field. FIG. 4 shows another possibility of generating this cursor window signal. Therein, the output 11 of the comparator 14 is no longer connected dire ctly to the programming input of the counter 16, but to an input of an AND-gate 58 whose other input is connected to the lead 29. Consequently, the counter 16 is not set for each raster line when the horizontal cursor position is reached by the display point, but only when at the same time the raster lines corresponding to the desired vertical position of the cursor have been reached. The counter 16 thus counts actually only during the display of the cursor field, whereas for the remainder of the time it occupies its initial position in which a logic signal "1" is generated on the lead 15 and hence a logic signal "0" is generated on the lead 59, via the inverter 17, so that via the AND-gate 18 the counting of the counter 16 is prevented by means of the pixel frequency signals supplied via the lead 7. On the other hand, the logic signal on the lead 59 is logic "1" only during the display of the cursor, so that the AND-gate 30 in FIG. 1 can be dispensed with and the signal on the lead 59 can be used directly for controlling the corresponding inputs of the elements 32 and 48.

What is claimed is:

1. A display device, comprising:

image generating means for generating an image in a raster scan format of pixels, said image generating means comprising cursor generating means for cursor generating and mixing means fed by said cursor generating means for mixing said cursor into said raster scan format for displaying, said cursor generating means comprising input means for receiving recurrent scanning control signals comprising a pixel clock signal, indicator means for indicating the position of a cursor field in the image, clip means fed by said input means and by said indicator means for generating a binary cursor window signal, a cursor memory having a plurality of locations each for storing a data word, all stored data words indicating at least one cursor pattern, addressing means fed by said input means and by said clip means for under control of a first value of said binary cursor window signal accessing successive locations for outputting data words, thereby advancing to each next location after a number of pixel clock signals which corresponds to the number of bits of each data word divided by a first number of bits used for the display of each cursor pixel, parallel-serial converter means for receiving each data word output by said memory and for supplying the first number of different consecutive bits of the received data word at each pixel clock signal which occurs during the first value of said binary cursor window signal, switch means controlled by said binary cursor window signal and fed by the parallel-serial converter for controlling the data supplied to a display device.

2. A circuit arrangement for controlling a cursor display in a raster scan image, said arrangement comprising:

input means for receiving recurrent scanning control signals comprising a pixel clock signal, indicator means for indicating the position of a cursor field in the image, clip means fed by said input means and by said indicator means for generating a bivalent cursor window signal, a cursor memory having a plurality of locations each for storing a data word, all stored data words indicating at least one cursor pattern, addressing means fed by said input means and by said clip means for under control of a first value of said binary cursor window signal accessing successive locations for outputting data words, thereby advancing to each next location after a number of pixel clock signals which corresponds to the number of bits of each data word divided by a first number of bits used for the display of each cursor pixel, parallel-serial converter means for receiving each data word output by said memory and for supplying the first number of different consecutive bits of the received data word at each pixel clock signal which occurs during the first value of said binary cursor window signal, switch means controlled by said clipping signal and fed by the parallel-serial converter for controlling the data supplied to a display device.

3. A circuit arrangement as claimed in claim 2, characterized in that the addressing means is advanced to the next location in response to a new raster line.

4. A circuit arrangement as claimed in claim 2 wherein said indicator means comprises:

first registers for storing position data determining the position of the cursor in the image, a second register for storing the number of lines of the cursor, a third register for storing the number of pixels per line of the cursor, a first counter for counting a number of lines which corresponds to the contents of the second register, and a second counter for repeated counting of a number of pixels corresponding to the contents of the register for each new line, the first registers comprising a first sub-register for storing the position of the cursor in the horizontal direction in the image and a second sub-register for storing the position of the cursor in the vertical direction in the image, a comparator which generates a first start signal when the horizontal control signals equal the contents of the first sub-register in order to set the first counter to a position corresponding to the contents of the second register and, subsequently, to make the first counter count at a pixel frequency until it reaches an initial position and to make it output a horizontal window signal for the duration of the counting, said comparator generating a second start signal when the vertical control signals equal the contents of the second sub-register in order to set the second counter to a position corresponding to the contents of the third register and, subsequently, to make the second counter count at a line frequency until it reaches an initial position and to make it output a vertical window signal for the duration of counting, the combination of the two window signals determining the binary cursor window signal.

5. A circuit arrangement as claimed in claim 4, further comprising:

a switch which applies the data output by the parallel-serial-converter to a display device;

a logic element for generating said binary cursor window signal from the two window signals serving to control said switch.

6. A circuit arrangement as claimed in claim 4, further comprising:

a switch which applies the data output by the parallel-serial converter to a display device;

the second counter serves to count the pixels only during the counting by the first counter and generates during counting said binary cursor window signal serving to control said switch.

* * * * *